US008624745B2

(12) United States Patent
Barson

(10) Patent No.: US 8,624,745 B2
(45) Date of Patent: Jan. 7, 2014

(54) HIGH SENSITIVITY AND HIGH FALSE ALARM IMMUNITY OPTICAL SMOKE DETECTOR

(75) Inventor: Michael Barson, Nuneaton (GB)

(73) Assignee: Honeywell International Inc., Morristown, NJ (US)

( * ) Notice: Subject to any disclaimer, the term of this patent is extended or adjusted under 35 U.S.C. 154(b) by 281 days.

(21) Appl. No.: 13/048,919

(22) Filed: Mar. 16, 2011

(65) Prior Publication Data

US 2012/0235822 A1 Sep. 20, 2012

(51) Int. Cl.
*G08B 17/10* (2006.01)

(52) U.S. Cl.
USPC ..... 340/630; 340/628; 340/629; 340/693.6

(58) Field of Classification Search
USPC ..... 340/630, 628, 629, 693.6
See application file for complete search history.

(56) References Cited

U.S. PATENT DOCUMENTS

| | | | | |
|---|---|---|---|---|
| 4,379,290 | A * | 4/1983 | Muggli et al. | 340/629 |
| 4,543,815 | A * | 10/1985 | Troup et al. | 73/28.01 |
| 6,052,058 | A * | 4/2000 | Knox | 340/607 |
| 6,218,950 | B1 | 4/2001 | Politze et al. | 340/630 |
| 6,515,589 | B2 | 2/2003 | Schneider et al. | 340/630 |
| 7,669,457 | B2 * | 3/2010 | Griffith et al. | 73/31.01 |
| 7,777,633 | B2 * | 8/2010 | Knox et al. | 340/607 |
| 2009/0025443 | A1 | 1/2009 | Griffith et al. | 73/31.02 |
| 2011/0314902 | A1 | 12/2011 | Dantler | |

FOREIGN PATENT DOCUMENTS

| | | | |
|---|---|---|---|
| EP | 2 320 398 | A1 | 5/2011 |
| WO | WO 2009/015178 | A1 | 1/2009 |

OTHER PUBLICATIONS

European Search Report, dated Oct. 8, 2013, corresponding to Application No. EP 12 15 9547.

* cited by examiner

*Primary Examiner* — Toan N Pham
(74) *Attorney, Agent, or Firm* — Husch Blackwell

(57) ABSTRACT

A high sensitivity smoke detector includes a housing which defines an internal, closed, scattering region, and an external, open scattering region. A cyclone-type separator draws atmosphere adjacent the external scattering region into the detector and separates the larger, non-smoke related particulate matter which flows into the internal, closed scattering region for sensing and subsequent analysis. An annular inflow pattern can be established with a central exit flow.

16 Claims, 8 Drawing Sheets

HIGH SENSITIVITY AND HIGH FALSE ALARM IMMUNITY OPTICAL SMOKE DETECTOR

FIELD

The application pertains to smoke detectors having multiple sensing regions in combination with a particle separator. More particularly, the application pertains to optical-type detectors having multiple scatter angles.

BACKGROUND

Smoke sensors using the optical scatter principal are increasingly becoming the most common type of fire sensor on the market. Optical sensors however are very sensitive to non-fire aerosols like water vapor (condensed steam and mist), dust and ash, spores, cooking aerosols, insects and spiders.

Optical techniques are becoming common that attempt to differentiate between different types of smoke and non-smoke aerosols. Common techniques used in an optical scatter chamber are the use of different wavelength LEDS e.g. blue and near infra-red or different scatter angles e.g. 140 degrees and 70 degrees (or even a combination of both). In all these techniques a ratio is made between two different optical scatter paths in a common chamber. This ratio can then indicate the particle size of the aerosol in the chamber and therefore if the smoke is grey (larger particles) or black (smaller particles). That can be very difficult, is detecting non-fire aerosols, for example water vapor, as this can be generated at extremely high levels over a range of particle sizes very similar to the particle size of grey smoke. Therefore depending on the conditions under which the water vapor is generated, little or no difference can be detected in the optical ratio from that of grey smoke.

Note that this can also be true of other non-fire aerosols, so much so that manufactures usually resort to reducing false alarms by making the smoke sensor have a low sensitivity to grey smoke and by the use of spike detection (delaying detection if the aerosol profile changes too fast). It should be noted that repeated spike detection may also produce an excessive smoke detection delay. An alternative technique is to use a very fine filter material on the sensor and suck air thought it into the smoke chamber. Using such fine filters will require regular maintenance well before it starts to block the detection of larger smoke particles.

DETAILED DESCRIPTION

Figure 1:
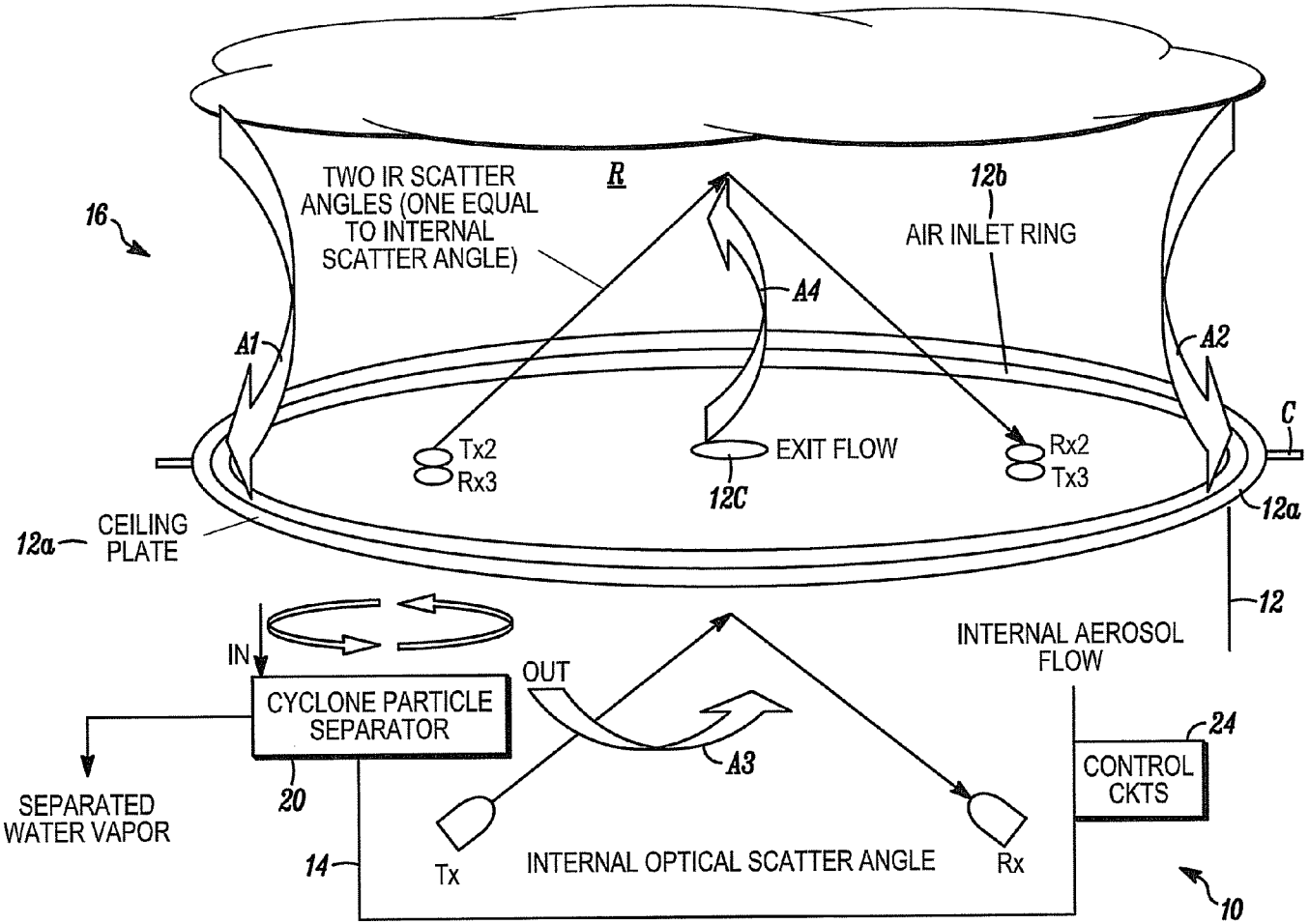
FIG. 1 illustrates an inverted and simplified view of an exemplary detector as mounted on a ceiling is a perspective view of a pontoon boat in accordance with the invention.

While disclosed embodiments can take many different forms, specific embodiments thereof are shown in the drawings and will be described herein in detail with the understanding that the present disclosure is to be considered as an exemplification of the principles thereof as well as the best mode of practicing same, and is not intended to limit the application or claims to the specific embodiment illustrated.

The present application relates to a ceiling mounted point fire detector that is designed, in one aspect, to be loop powered from an analogue, or digital, addressable fire alarm system. The detector includes an internal optical scatter chamber which samples the external environment via an output from a multi-stage cyclone particle separator. Air is returned to the external environment, via an exit point below which an open optical scatter chamber monitors the circulating air flow.

The multi-stage cyclone can be driven by a fan which is triggered-on after combustion products and/or aerosols are detected in the external environment. The cut diameter of the cyclone is set to remove almost all large (heavy) non-fire particles from the air flowing into the internal chamber, whilst smaller smoke aerosols are unaffected. This allows rapid and accurate smoke detection whilst being insensitive to massive quantities of non-fire aerosols.

So that the detector could detect the early phase of a fire, the internal scatter angle, wavelength and sensitivity are identical to the external scatter angle, which senses the external environment circulating above the exit flow. The ratio of both scatter paths is taken when the cyclone is active, giving a unity ratio for all smoke types. Accurate high sensitivity detection can now be applied to the internal scatter chamber for very early smoke detection. For non-fire aerosols, for example water vapor, the external to internal optical chamber sensitivity ratio will be far more than 100, enabling its easy identification and rejection as a false alarm.

Figure 2:
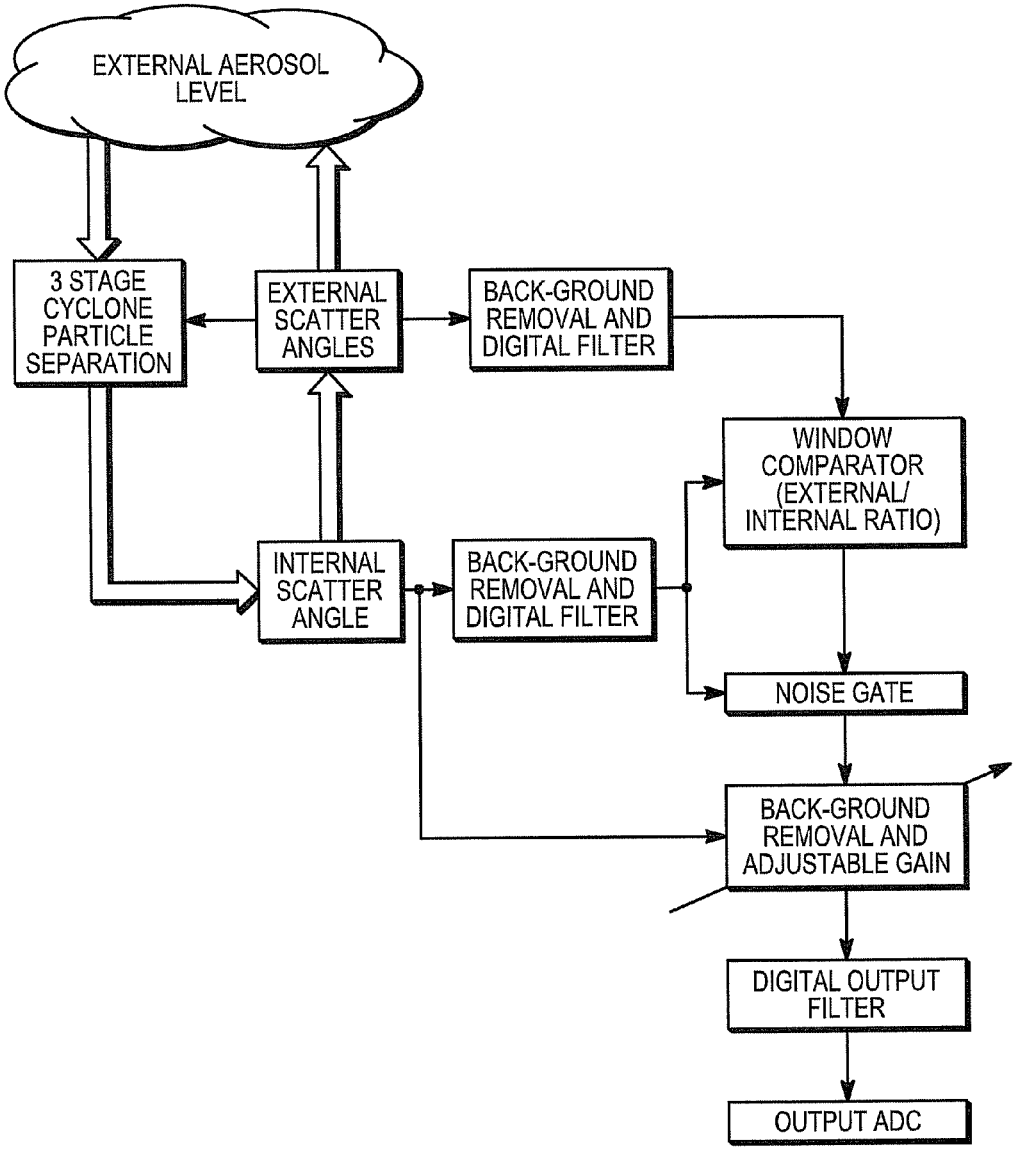
FIG. 2 is a block diagram of the external to internal optical ratio, smoke detection process.

Referring to FIG. 1 and FIG. 2, a detector 10 includes a housing 12 which is releasibly attachable to a surface, such as a ceiling C by means of a ceiling plate 12*a*. The detector 10 can monitor ambient atmospheric conditions of an adjacent region R.

Detector 10 includes an internal, or closed, optical scattering chamber 14 and an external, or open optical scattering chamber 16. Ambient air A1, A2 is drawn into detector 10 via inflow ports in an air inlet ring 12*b* by the action of a particle separator 20. Separator 20 can include a fan or other type of air moving unit, without limitation.

Separator 20 could be implemented as a multi-element cyclone-type particle separator. It will be understood that a variety of separators come/within the scope of the claims hereof. Exemplary separators have been disclosed in US Patent Application No 2009/0025453 published Jan. 29, 2009, entitled "Apparatus and Method of Smoke Detection". The published '453 application is assigned to the assignee hereof and incorporated herein by reference.

Water or water vapor is separated from ambient particulate matter by separator 20 and the remaining particulate matter flows, for example A3 into the internal optical scattering chamber 14. Outflow of A3 is from the chamber 14 through exit flow port 12*c* into the environment R.

While in the chamber 14 the airborne particulate matter scatters light from transmitter Tx. Scattered light is detected at receiver Rx. Both transmitter Tx and receiver Rx are coupled to control circuits 24. Circuits 24 can include analog/digital conversion circuitry as well as digital filter circuitry to implement the processing disclosed in FIG. 2.

Circuitry 24 can provide wired or wireless communications capability to an associated fire alarm monitoring system, not shown.

The external, or open, scattering chamber 16 includes first and second pairs of transmitter/receiver units Tx2/Rx2 and Tx3/Rx3. The two pairs of transmitter/receiver units are also coupled to control circuits 24. As those of skill will understand, two different scattering angles, one of which corresponds to the scattering angle of the chamber 14, can be provided.

The detector 10 advantageously presents a very low profile when viewed from the region R. The ceiling plate 12*a* can be substantially flat with the housing 12 extending away from the region R into the ceiling C to promote a very non-intrusive appearance.

The detector 10 monitors the ambient region R below that detector using two external near infra-red optical scatter angles. If relatively small levels of particulates move into this area, then a multi-stage cyclone, such as cyclone 20, is energized to draw the particulates in the ambient air, such as A1, A2, through the air intake ports in ring 12*b*, in the flat ceiling plate 12*a*. The multi-cyclone particle separator 20 removes almost all of any large non-fire aerosols that may be present, and then passes part of the sampled air, A3, into the internal optical scattering chamber 14 for smoke sensing.

The cyclone separator 20 can also be activated if low levels of CO or heat are detected or combined levels of any of the three monitored phenomena which could be indicative of the early phase of a fire. The rate or 'duty cycle' at which the multi-cyclone 20 will operate at, also can be increased with the levels of the monitored phenomena monitored.

Air drawn through the air inlet or ports in ring 12*b*, is passed via a mesh into the first cyclone stage, which is formed, for example, in a region of rotating air above a centrifugal fan with an area of exposed fan blades. This stage is primarily designed to remove large quantities of water vapor without clogging-up and minimizing the amount of water vapor passing to the centrifugal fan and final cyclone stage. The air flow through the inlet mesh is forced to be almost parallel to the mesh wires in order to maximize coalescent particle growth before the air flow enters the inlet holes of the cyclone. Liquid water is separated out on the side walls and allowed to drain back through the cyclone inlet holes.

The centrifugal fan drives the multi-cyclone 20 and actually forms the second stage of the particle separator. The fan is powered from a super-capacitor power supply, to average out the input current taken from the fire alarm loop. The fan speed and rotor blade radius determines the efficiency of this stage, with the first cyclone stage increasing the rotor speed due to the drop in air pressure. The outlet flow of the centrifugal fan is mostly returned to the external environment via an exit port 12*c*. However a small fraction of its output flow is fed into the final stage of the multi-cyclone 20. The aerosol density of the small faction of air flow at this point is representative of the entire aerosol density due to the mixing effect of the fan.

The final cyclone stage uses a tangential input, axial output reverse lift cyclone that is designed for a very sharp cut diameter of above 1 micron. This is achieved by the forced air flow into the tangential input and by feeding the axial output back into the fan input to provide suction in a small diameter vortex finder pipe. An additional cork-screw lift section is also used in the cyclone; while the conical exit section is reduced in length to fit into the sensor, this exit section also recombines with the main exit of the centrifugal fan. The filtered air flow from the axial output of the final cyclone stage is fed into an evaporation chamber before passing through the internal optical scatter chamber 14 and returned to the output 12*c*.

The main exit point 12*c* from the detector 10, allows the air flow to be passed back into the external protected area R, setting up a 'donut' shaped convection current, ensuring that fire products around and below the sensor can be sampled. If a real fire is present, then the sensed levels in the internal, or detection chamber 14 quickly, build up and the presence of a fire can be quickly and accurately detected.

After detecting a fire, the multi-cyclone 20 runs at a low 'duty-cycle' to reduce power, whilst the levels in the detection chamber 14 can still be monitored to track any further build up of the fire products around the detector 10. This process also ensures that the chamber 14 can still be purged with clear air after a fire. If however, the sensed levels indicate that a non-fire aerosol triggered the cyclone 20, then it can be switched-off, until the monitored levels again indicate a possible fire. A constant re-triggering from a non-fire aerosol can also cause the cyclone 20 to enter the low 'duty cycle' mode.

As the air flow in to the optical scatter chamber does not pass through a high filtration material filter, particles can not build-up on the filter and block it. Alternatively both large and small particles pass through the detector with the larger particles ejected at different point before recombining into a common exit point. As the multi-cyclone is event triggered, then the possibility of the detector being blocked by a build up of debris in a normal environment is effectively no more significant than a detector without a forced air flow and so requires no maintenance throughout its expected life.

One of the external optical scatter angles above the main exit point 12*c* has the same infra-red wavelength, sensitivity and scatter angle as the internal optical scatter angle in the chamber 14. This external scatter angle senses the external environment circulating above the exit point 12*c* when the cyclone is active. The analogue to digital conversion (ADC) outputs from both scatter paths have their background off-sets (clean-air readings) removed and are then digitally filtered with an update rate of between 5S to 20S, after this integration time a window comparator tests the ratio of both scatter paths. As the ratio must be unity for all smokes types, the window comparators ratio limits can be set quite wide for example 0.5 to 2.0. If the ratio is within the comparators limits and the signal is high enough for accurate calculations (a noise gate function) then the background readings are removed, before a high gain is applied to the ADC readings coming from the internal scattering chamber 14. A digital filter is then applied to this reading to before it is compared to a fire level, giving accurate and high sensitivity detection for very early smoke detection.

For non-fire aerosols, for example water vapor, the external to internal optical chamber sensitivity ratio will be far more than 100 i.e. well outside the window comparators limits, so the gain applied to the output of the internal scatter chamber will be only for normal smoke detection sensitivity. Alternatively the gain, could be switched to a relatively low sensitivity, however this is not necessary as the cyclone removes nearly all the water vapor and there will be little or no response from the internal chamber, hence no false alarm is possible at any level of water vapor known to occur in practice. As the optical scatter ratio easily identifies the aerosol as a false alarm source, it can also indicate this to the fire alarm panel if this condition lasts for an excessive amount of time. Note that in the above description an enclosed external optical scatter chamber could be used instead of an open optical scatter angle with equal performance benefits.

A thermistor can also be positioned in the exit point 12*c*, just below the surface of the detector 10, so that if a small change in the ambient air temperature is detected by the thermistor, then the centrifugal fan can be turned-on to sample the external air temperature and provide a fast heat detection response from the thermistor i.e. the buried thermistor can overcome the thermal inertia of the surrounding detector without having to protrude down from the ceiling in a protected molding feature.

Figure 3A:
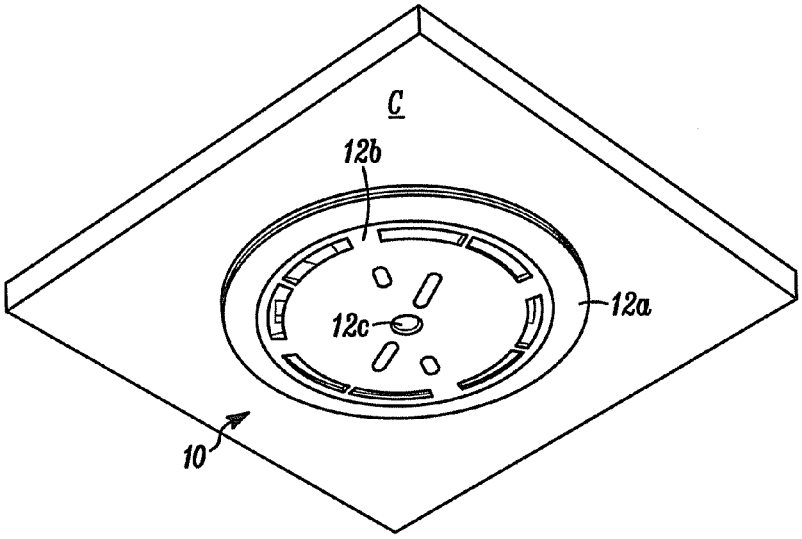
FIGS. 3A, 3B, and 3C illustrate additional aspects of a detector as in FIG. 1.
Figure 3B:
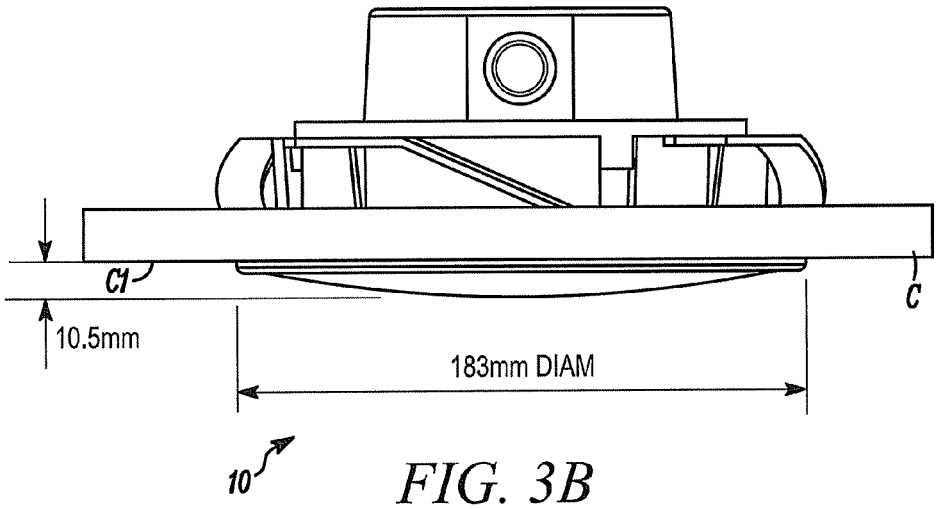
Figure 3C:
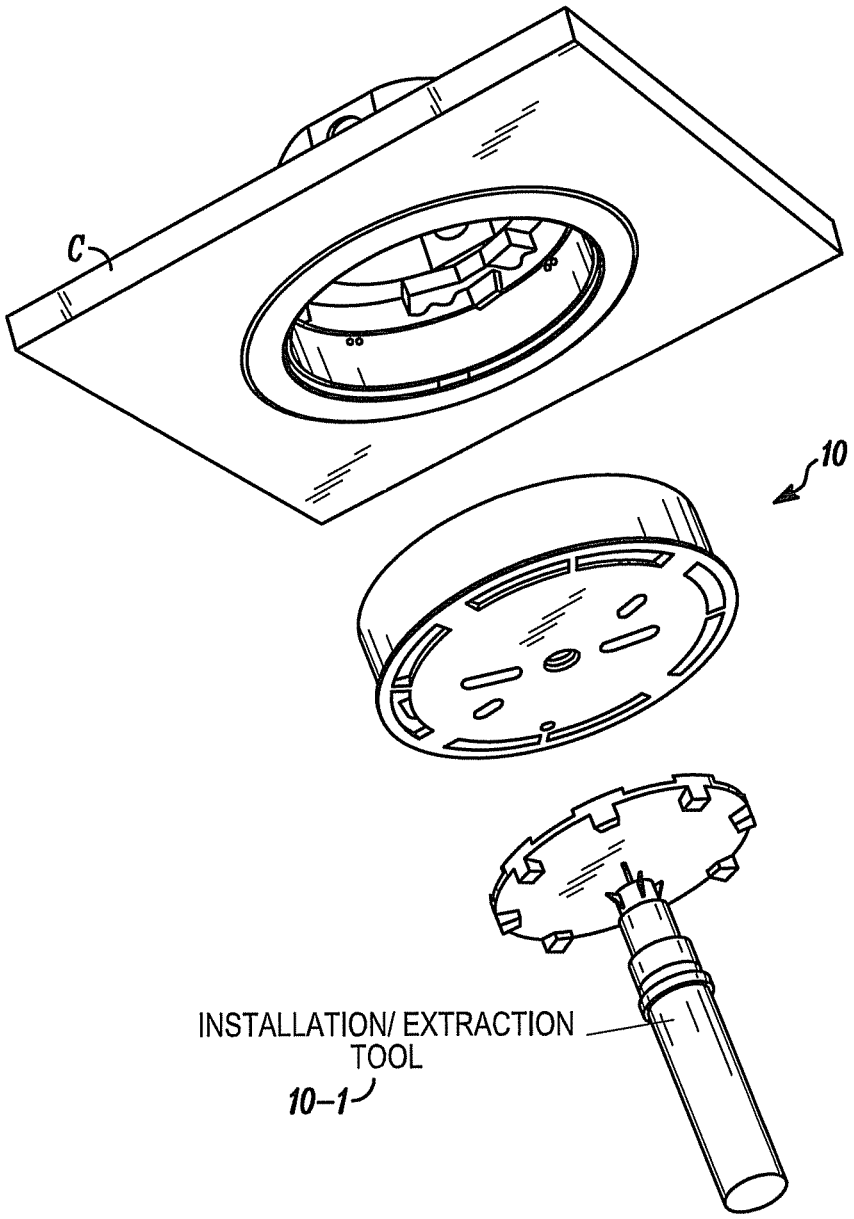

FIGS. 3A, 3B, and 3C illustrate aspects of the detector in accordance herewith. FIG. 3A illustrates the detector 10 mounted into the ceiling C. FIG. 3B a side view of the detector 10 illustrates how the detector 10 extends behind the ceiling C, away from an external surface C1 of the ceiling C. FIG. 3C illustrates use of an installation/extraction tool 10-1 for use with the detector 10.

Figure 4:
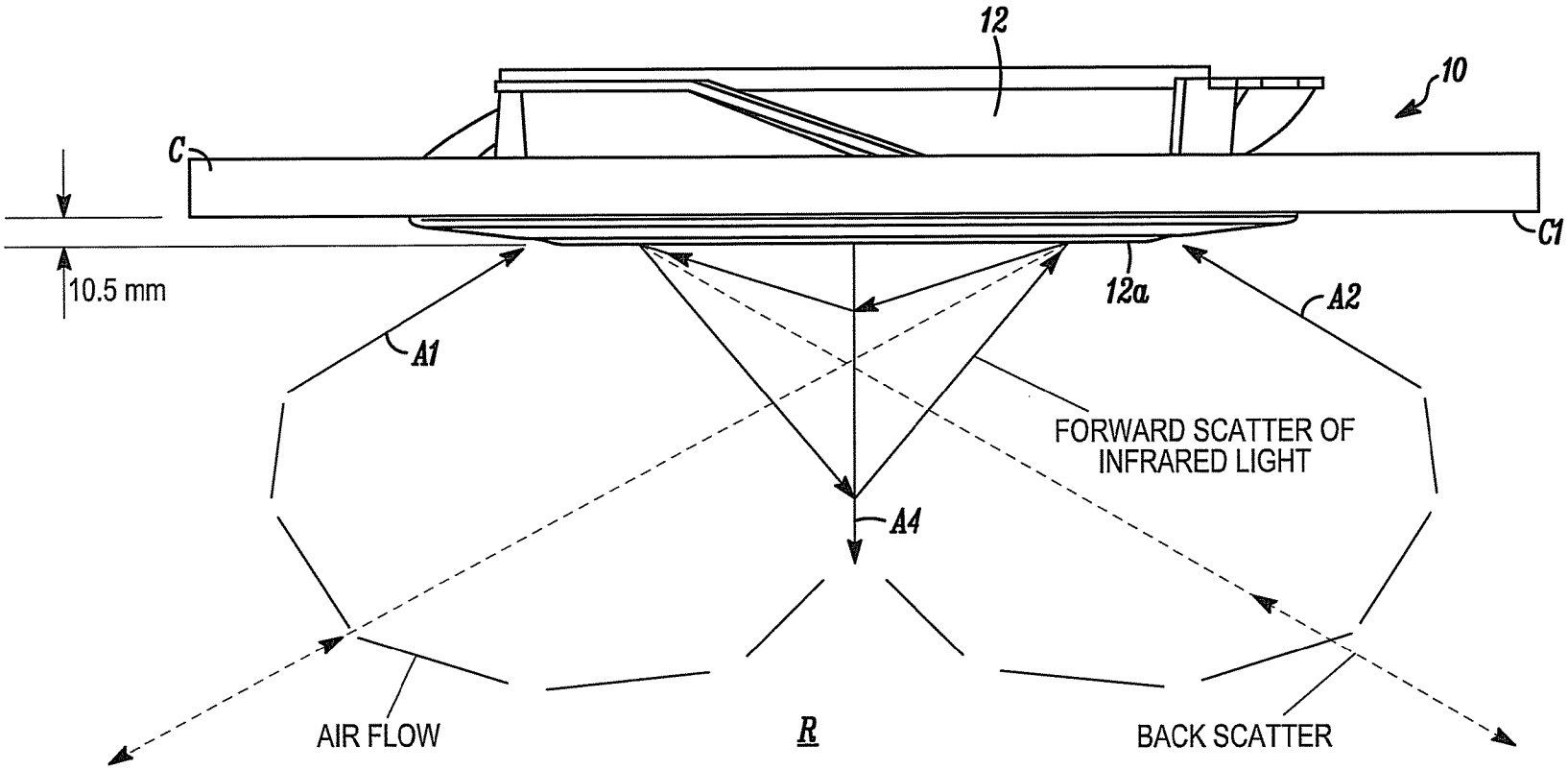
FIG. 4 illustrates aspects of the external air flow and external particulate induced scattering.
Figure 5B:
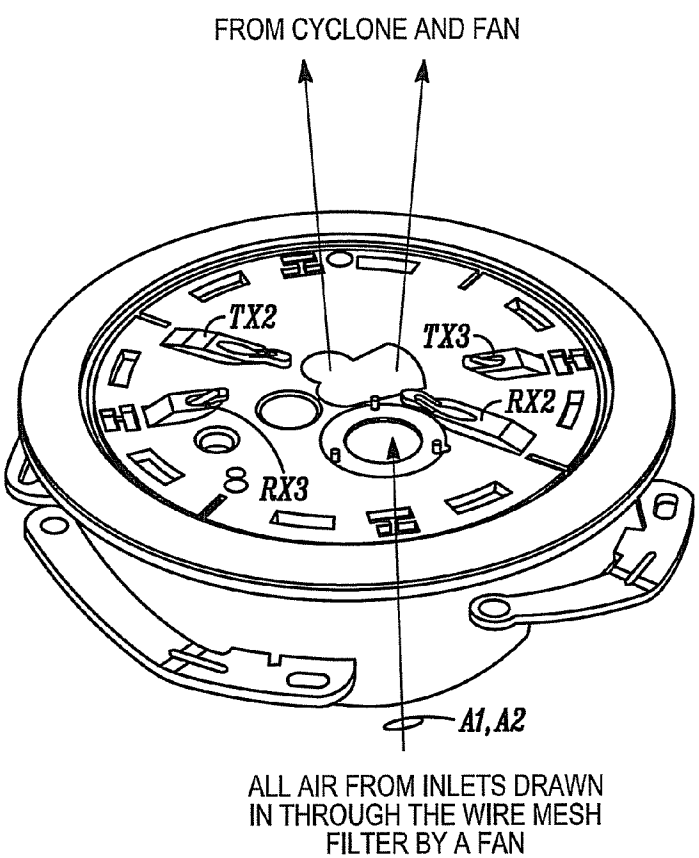
FIGS. 5A, 5B illustrate additional aspects of the detector of FIG. 1.
Figure 5A:
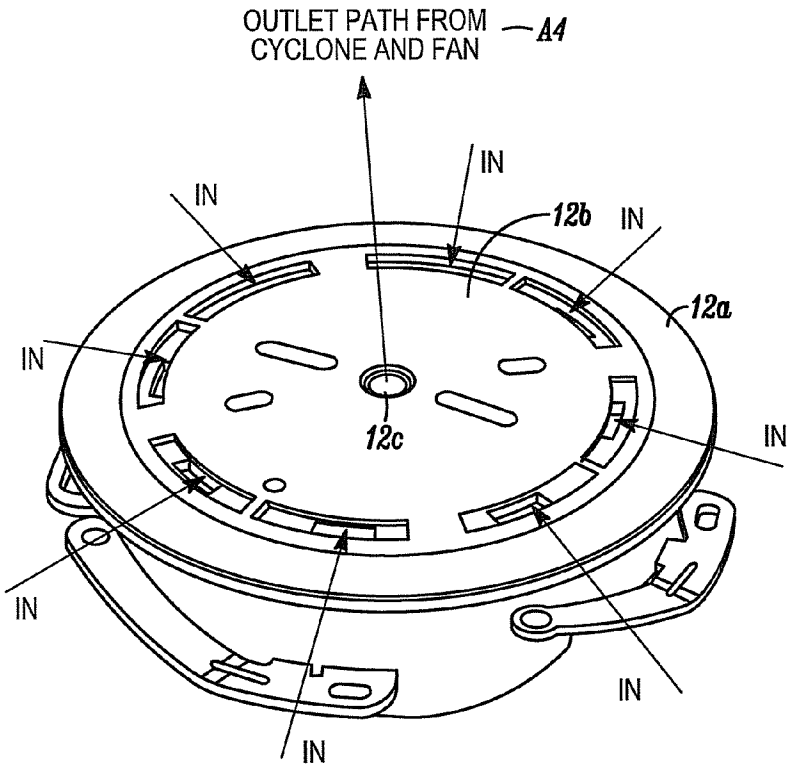
Figure 6:
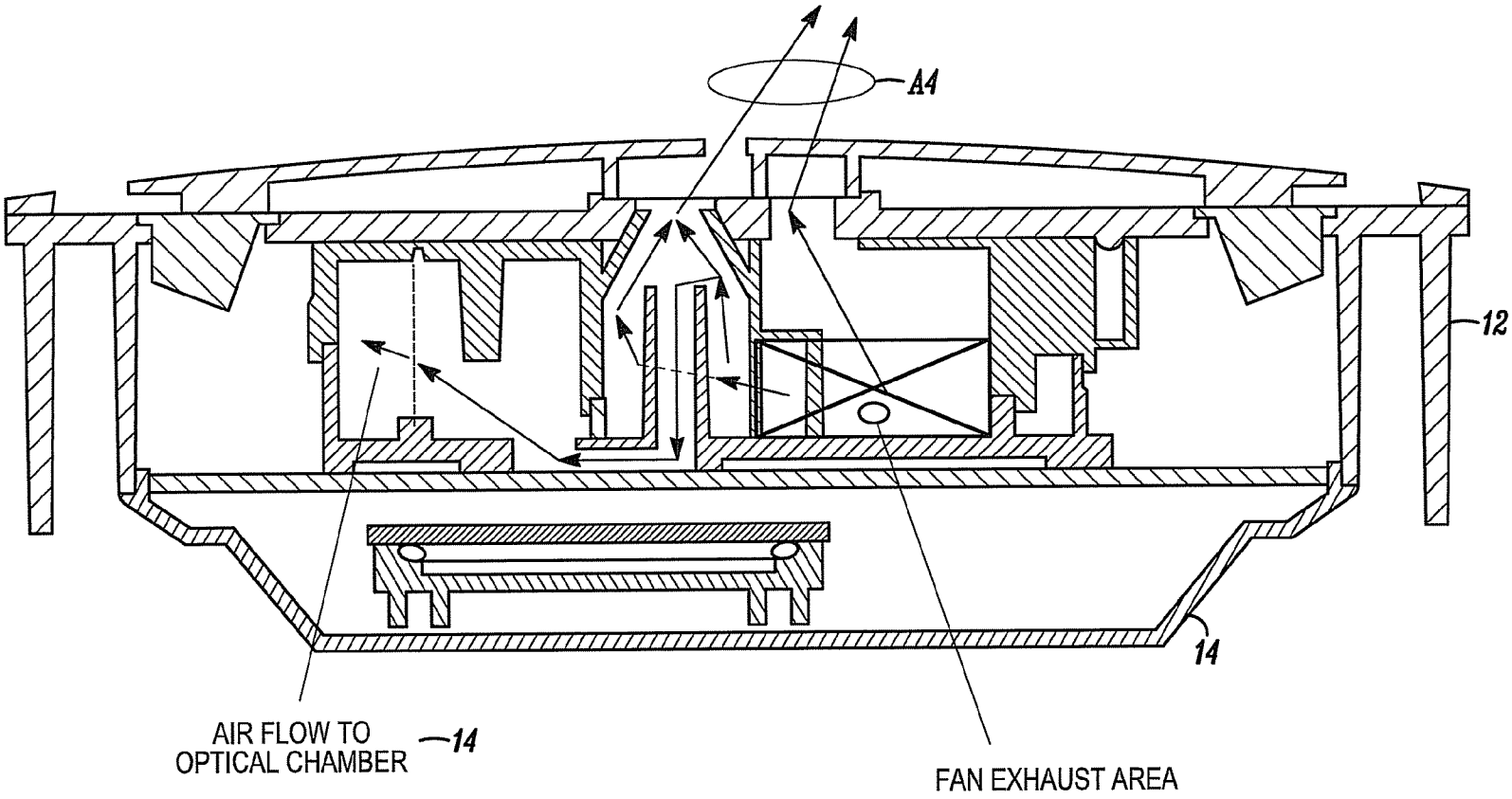
FIG. 6, a side sectional view illustrates internal flow.
Figure 7A:
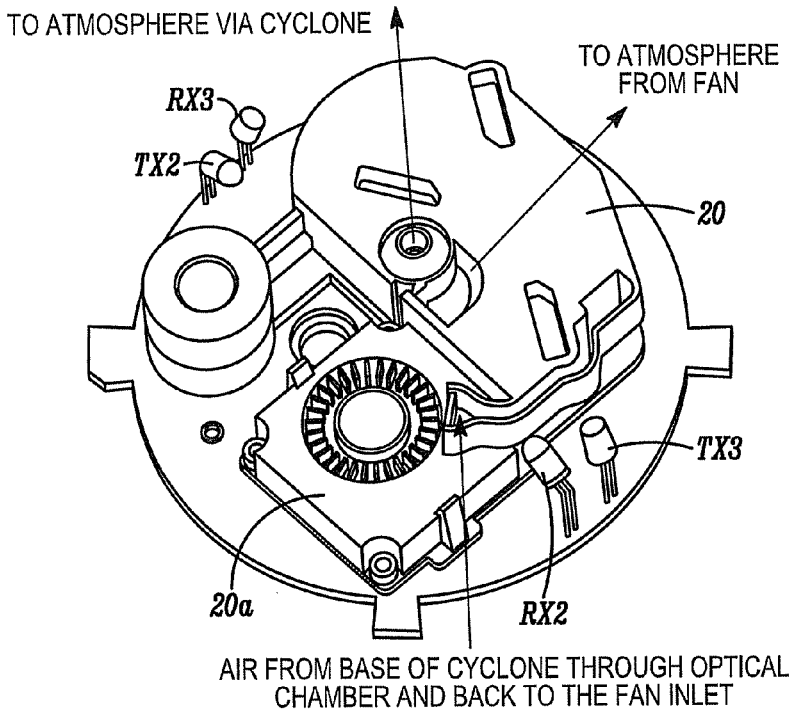
FIGS. 7A, 7B illustrate various components of the detector of FIG. 1.
Figure 7B:
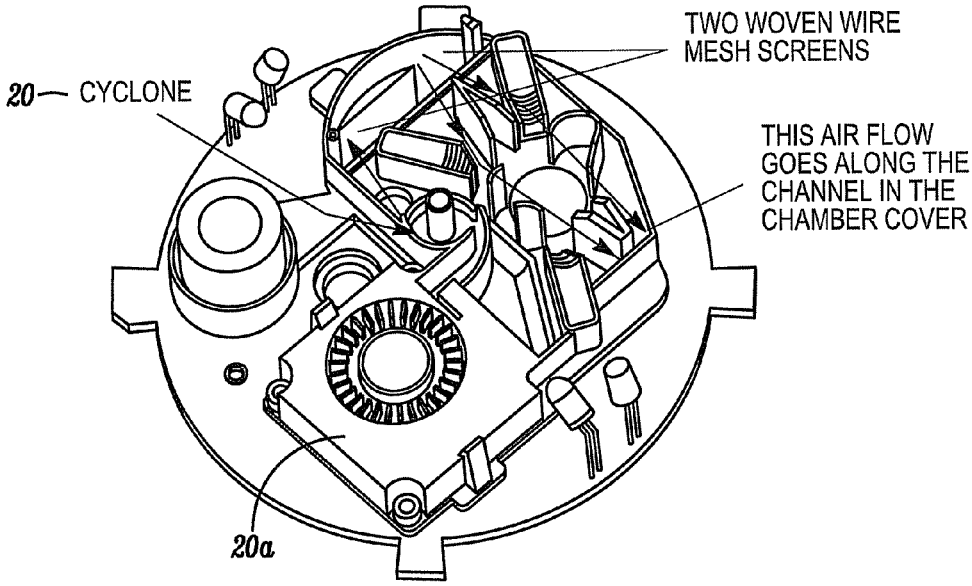

In FIG. 4 illustrates external airflow, A1, A2, and A4 along with transmission and scattering associated with the external sampling region 16. In FIGS. 5A, 5B further details of air flow and optical component placement for the external, open scattering region 16 are illustrated. FIG. 6, a side sectional view illustrates aspects of internal air flow in the detector 10. FIGS. 7A, 7B illustrate air flow as exiting the cyclone separator 20. The fan 20*a* implementable as a centrifugal fan, is illustrated in FIG. 7B coupled to the separator 20.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. A low profile smoke detector comprising:

an internal optical scattering chamber;

a particle separator, adjacent to the chamber;

a housing for the chamber and the separator; and a mounting ring attachable to a selected surface, where the separator removes selected non-fire aerosols to facilitate smoke detection in the chamber in response to remaining particulate matter, where the ring is annular and has a substantially flat, annular surface, and where the housing relasibly engages the ring and extends past the annular surface.

2. A detector as in claim 1 where the separator comprises a cyclone-type particle separator.

3. A detector as in claim 2 where the separator comprises a small input cyclone for removal of selected amounts of water vapor without clogging.

4. A detector as in claim 1 which includes an external optical scattering chamber.

5. A detector as in claim 4 where the external chamber has associated therewith an external scatter angle and the internal chamber has associated therewith an internal scatter angle, and including circuits, responsive to scattering signals associated with the chambers, to form a ratio to discriminate between smoke and non-smoke aerosols.

6. A detector as in claim 5 where the circuitry, in response to the ratio, makes a smoke determination.

7. A detector as in claim 6 where the external chamber includes multiple scattering angles.

8. A detector as in claim 7 which includes a housing for the chambers and the separator and a surface mounting plate, where the housing is coupled to the plate and extends axially therefrom with the plate attachable to the surface and with the housing extending away from the surface.

9. A detector as in claim 1 which includes an external optical scattering chamber and where the external chamber has associated therewith an external scatter angle and the internal chamber has associated therewith an internal scatter angle, and including circuits, responsive to scattering signals associated with the chambers, to form a ratio to discriminate between smoke and non-smoke aerosols.

10. A detector as in claim 9 which includes:

a thermal sensor, a fan, and circuitry coupled to the thermal sensor and the fan, where the fan directs ambient air toward the thermal sensor; and the circuitry responsive thereto makes a heat determination.

11. A fire sensor for detecting fire in a monitored region, the fire sensor comprising:

a chamber in fluid communication with the monitored region via at least one inlet;

an internal detector assembly adapted to detect fire products within the chamber and to output a corresponding internal detection signal;

an external detector assembly adapted to detect fire products outside the chamber in the monitored region and to output a corresponding external detection signal;

a cyclone separating device adapted to draw a sample of atmosphere from the monitored region into the chamber through the at least one inlet; and a controller adapted to activate a fluid transport device upon receipt of a trigger signal based on the external detection signal to thereby draw a sample of the atmosphere from the monitored region into the chamber for analysis by the internal detector assembly, where the chamber is provided with an outlet enabling the atmosphere sampled from the monitored region to escape from the chamber to the monitored region, the outlet being disposed adjacent to the at least one inlet such that circulation of atmosphere adjacent the fire sensor within the monitored region is established when the fluid transport device is active.

12. A fire sensor according to claim 11, further comprising a processor adapted to determine whether the external detection signal meets a predetermined trigger criterion and, if so, to generate the trigger signal.

13. A fire sensor according to claim 11 further comprising a control circuits adapted to evaluate whether the internal detection signal meets a predetermined alarm criterion, if so, to generate an alarm signal and, if not, to generate a deactivate signal whereby the controller deactivates the cyclone separating device.

14. A fire sensor according to claim 11 wherein an inlet/outlet configuration is selected from a group where the inlet comprises multiple inlet points surrounding the outlet, or the outlet comprises multiple outlet points surrounding the inlet, such that a substantially toroidal circulation path is established adjacent the fire sensor, the multiple inlet or outlet points preferably being arranged to form an annulus.

15. A fire sensor as in claim 11 which includes a mounting ring attachable to a selected surface, and a housing which carries at least the chamber and the detectors wherein the housing removably engages at least a portion of the ring.

16. A fire sensor as in claim 15 where the ring has a selected surface with the housing, at least in part, extending away from the surface.

* * * * *